US011019976B1

(12) United States Patent
Hangyu

(10) Patent No.: US 11,019,976 B1
(45) Date of Patent: Jun. 1, 2021

(54) WATER TANK STRUCTURE AND VACUUM CLEANER

(71) Applicant: Keewoo Robotics Technology Co., Ltd., Shenzhen (CN)

(72) Inventor: Wu Hangyu, Shenzhen (CN)

(73) Assignee: Keewoo Robotics Technology Co., Ltd., Baoan District (CN)

( * ) Notice: Subject to any disclaimer, the term of this patent is extended or adjusted under 35 U.S.C. 154(b) by 0 days.

(21) Appl. No.: 17/090,767

(22) Filed: Nov. 5, 2020

(30) Foreign Application Priority Data

Sep. 30, 2020 (CN) ..... 202011058746.X

(51) Int. Cl.
*A47L 11/40* (2006.01)
*A47L 11/30* (2006.01)

(52) U.S. Cl.
CPC ..... *A47L 11/4013* (2013.01); *A47L 11/302* (2013.01)

(58) Field of Classification Search
CPC ..... A47L 11/4013; A47L 11/302
See application file for complete search history.

(56) References Cited

U.S. PATENT DOCUMENTS

2017/0071434 A1* 3/2017 Nguyen ..... A47L 11/4044

* cited by examiner

*Primary Examiner* — Andrew A Horton
(74) *Attorney, Agent, or Firm* — Cooper Legal Group, LLC

(57) ABSTRACT

The present disclosure relates to a water tank structure and a vacuum cleaner. The water tank structure includes a tank body and a tank cover assembly. The tank body has an accommodation cavity therein, and an end of the tank body is formed with an opening in communication with the accommodation cavity. The tank cover assembly includes a cover body and at least one flow divider, and the cover body is disposed at an end of the tank body proximate to the opening. The flow divider is in communication with the cover body and the accommodation cavity. The flow divider is configured to divide a fluid flowing therethrough into a plurality of fluid streams formed into pairs having paired kinetic energies carried thereby and paired opposing flow directions, such that the kinetic energies of the pairs of fluid streams cancel out.

20 Claims, 5 Drawing Sheets

WATER TANK STRUCTURE AND VACUUM CLEANER

CROSS-REFERENCE TO RELATED APPLICATION

The present application claims priority to Chinese Patent Application 202011058746.X, filed on Sep. 30, 2020, which is incorporated herein by reference.

TECHNICAL FIELD

The present disclosure relates to the technical field of cleaning apparatuses and in particular to a water tank structure and a vacuum cleaner.

BACKGROUND

The water tank for storing dirty water and debris of the prior art cleaning apparatus has a complex internal structure and occupies a large internal storage space, and debris is prone to be tangled therewith and adhered thereto and is thus difficult to remove, resulting in germs breeding. In addition, air entering the water tank is prone to drive dirty water stored in the water tank to fluctuate, causing the dirty water to be sucked into a motor. In this situation, the motor can be damaged easily, and the dirty water can be carried by the air and blown out of the cleaning apparatus to contaminate the environment again, leading to a low utilization rate of storage space in the water tank.

SUMMARY

The objective of embodiments of the present disclosure is to solve the following technical problems: removing debris from the complex internal structure of the prior art water tank is difficult, the utilization rate of storage space in the water tank is low, and dirty water can be easily carried by air to flow out of the water tank.

In order to solve the aforementioned technical problems, an embodiment of the present disclosure provides a water tank structure using the following technical solution:

the water tank structure comprises a tank body and a tank cover assembly;

the tank body defines an accommodation cavity, and a first end of the tank body defines an opening in communication with the accommodation cavity;

the tank cover assembly comprises a cover body and a flow divider, and the cover body is disposed at the first end of the tank body proximate to the opening; the flow divider is in communication with the cover body and the accommodation cavity;

the flow divider is configured to divide a fluid flowing therethrough into a plurality of fluid streams formed into pairs, and each of the pairs of fluid streams has paired opposing flow directions.

In order to solve the aforementioned technical problems, an embodiment of the present disclosure further provides a water tank structure using the following technical solution:

the water tank structure comprises a tank body and a tank cover assembly;

the tank body defines an accommodation cavity, and a first end of the tank body defines an opening in communication with the accommodation cavity;

the tank cover assembly comprises a cover body and a flow divider, and the cover body is disposed at the first end of the tank body proximate to the opening; the flow divider is in communication with the cover body and the accommodation cavity;

the flow divider is configured to divide a fluid flowing therethrough into a plurality of fluid streams formed into pairs, and each of the pairs of fluid streams has paired kinetic energies and paired opposing flow directions such that the kinetic energies of the pairs of fluid streams cancel out.

As a further improvement to the aforementioned technical solution, each of the pairs of fluid streams has equal kinetic energies so as to increase an available space of the water tank structure.

As a further improvement to the aforementioned technical solution, a ratio of a maximum kinetic energy to a minimum kinetic energy carried by any one of the pairs of fluid streams is greater than 0.9.

As a further improvement to the aforementioned technical solution, each of the pairs of fluid streams has mutually-mirroring flow directions.

In order to solve the aforementioned technical problems, an embodiment of the present disclosure further provides a water tank structure, and the water tank structure comprises a tank body and a tank cover assembly;

the tank body defines an accommodation cavity therein, and a first end of the tank body defines an opening in communication with the accommodation cavity;

the tank cover assembly comprises a cover body and a first flow channel; the cover body is disposed at a first end of the tank body proximate to the opening; the first flow channel is in communication with the cover body and the accommodation cavity; a terminal end of the first flow channel is provided with an even number of outlets;

a fluid flowing in through the first flow channel is divided into a same number of fluid streams as the number of the outlets, and the fluid streams are formed into pairs, in which a first fluid stream of each pair and a second fluid stream of each pair have equal kinetic energies.

As a further improvement to the aforementioned technical solution, the tank cover assembly comprises a second flow channel, and the second flow channel is in communication with the cover body and the accommodation cavity;

the fluid streams collide with each other in the accommodation cavity such that air entrained in the fluid streams is separated therefrom, and the air separated from the fluid streams flows outside through the second flow channel.

As a further improvement to the aforementioned technical solution, all of the outlets of the first flow channel are directed towards a side wall of the tank body.

As a further improvement to the aforementioned technical solution, an inlet of the second flow channel is directed towards the side wall of the tank body.

As a further improvement to the aforementioned technical solution, a top end surface of the cover body is sloped; the cover body comprises a first end having a first height and a second end connected to the first end and having a second height greater than the first height; and the second flow channel is correspondingly disposed at the second end of the cover body.

As a further improvement to the aforementioned technical solution, the tank cover assembly comprises a filtration assembly; the filtration assembly comprises a support and a filter; at a position corresponding to an outlet of the second flow channel, an end of the cover body away from the tank body defines a discharging cavity configured to cause the air separated from the fluid streams to flow out;

the support is disposed on the cover body, and at a position corresponding to the discharging cavity of the cover body, a hollow portion is disposed on the support, and the filter is disposed on the hollow portion of the support.

In order to solve the aforementioned technical problems, an embodiment of the present disclosure further provides a vacuum cleaner using the following technical solution: the vacuum cleaner comprises a machine body and the aforementioned water tank structure; the water tank structure is detachably connected to the machine body.

As a further improvement to the aforementioned technical solution, the vacuum cleaner comprises a floor brush, a suction producing device, and a connecting tube; the floor brush, the water tank structure and the suction producing device are sequentially mounted on the machine body;

the connecting tube comprises a first end and a second end opposing and connected to the first end; the first end of the connecting tube is connected to the floor brush; the second end of the connecting tube is connected to the tank cover assembly of the water tank structure and is configured to be in communication with an inlet of the first flow channel; when subject to suction produced by the suction producing device, air-entrained dirty water and debris collected after a flow is scrubbed by the floor brush flow along the connecting tube through the first flow channel into the accommodation cavity of the tank body.

As a further improvement to the aforementioned technical solution, the vacuum cleaner further comprises a first seal member; wherein the first seal member is disposed at a connection point of the connecting tube and the tank cover assembly.

As a further improvement to the aforementioned technical solution, the vacuum cleaner further comprises a second seal member; wherein at a position at an outlet of the second flow channel, the second seal member is disposed at a connection point of the water tank structure and the machine body.

Compared with the prior art, the water tank structure and the vacuum cleaner provided by the embodiments of the present disclosure mainly have the following benefits:

in the water tank structure, the flow divider is disposed on the cover body covering the tank body such that a fluid, such as air-entrained dirty water and debris, can enter the accommodation cavity of the tank body by means of the flow divider. The flow divider is disposed on the cover body of the tank cover assembly such that the internal structure of the tank body can be simplified, reducing occupied space and facilitating cleaning.

In addition, when subject to suction, a fluid such as air-entrained dirty water and debris flows from the cover body through the flow divider and is divided in the flow divider into a plurality of fluid streams formed into pairs having opposing directions. The plurality of fluid streams flow into the accommodation cavity and collide with each other, such that the air entrained in the dirty water and debris is separated therefrom. The dirty water and debris are subject to the inertial effect caused by gravity and enter the bottom of the accommodation cavity of the tank body, and the air is discharged to an external environment, such that an interaction between kinetic energy of the air and kinetic energy of the dirty water and debris in the tank body can be suppressed, thereby suppressing fluctuation of the liquid level in the accommodation cavity of the tank body, effectively preventing the dirty water and debris from being blown away by the air into a motor or to the external environment and increasing the degree of separation of the air from the dirty water and debris.

In summary, the water tank structure has a simple structure and large storage space, can be easily cleaned and has high degree of separation of air from dirty water and debris.

BRIEF DESCRIPTION OF THE DRAWINGS

To illustrate the solutions in the present disclosure more clearly, the drawings to be used in the description of the embodiments will be introduced briefly as follows. It is apparent that the drawings in the following description are merely some embodiments of the present disclosure. For those of ordinary skill in the art, other drawings can be obtained according to these drawings without any inventive efforts. In the drawings.

DETAILED DESCRIPTION OF THE EMBODIMENTS

Figure 1:
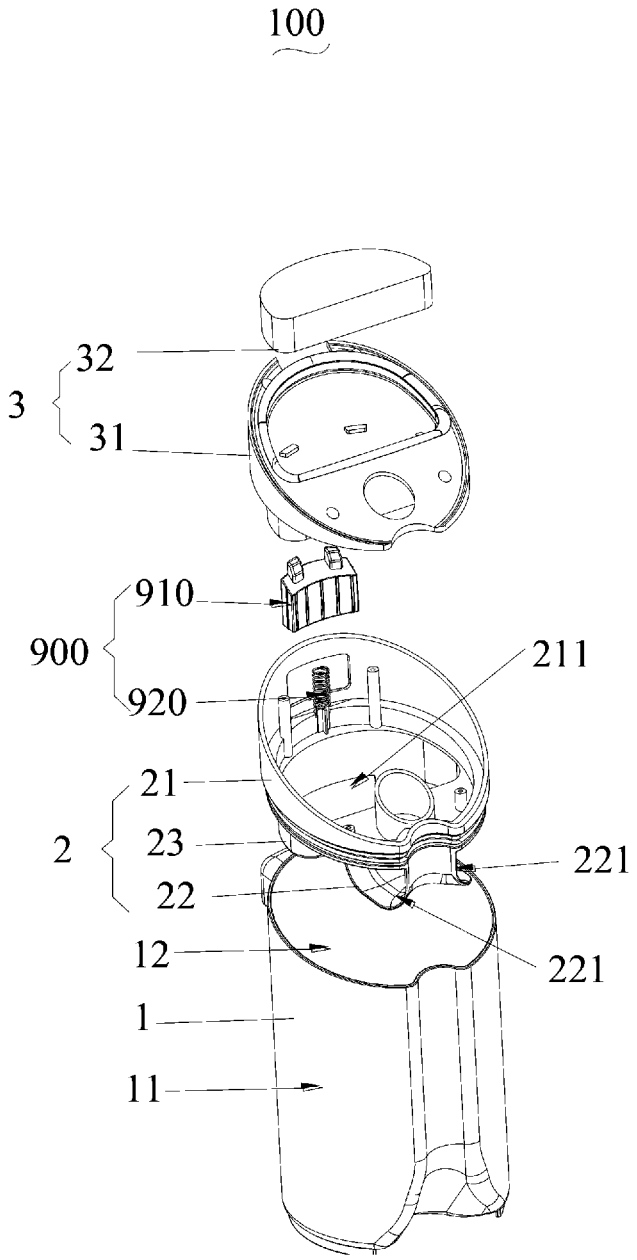
FIG. 1 is an exploded perspective view of a water tank structure according to an embodiment of the present disclosure.

Unless defined otherwise, all of the technical and scientific terms used herein have the same meanings as those usually understood by those of ordinary skill in the art in the technical field of the present disclosure. The terms used in the specification herein are merely intended to describe specific embodiments, and are not intended to limit the present disclosure. For example, directions or positions indicated by terms such as "length," "width," "up," "down," "left," "right," "front," "rear," "vertical," "horizontal," "top," "bottom," "in" and "out" are directions and positions shown on the basis of the drawing. These terms are merely for ease of description and cannot be construed as a limitation to the technical solution.

Terms "include" and "have" and any variations thereof in the description, claims and the brief description of the drawings of the present disclosure are intended to cover non-exclusive inclusion. Terms such as "first" and "second" in the description and claims or the brief description of the drawings of the present disclosure are used to distinguish between different objects and are not used to describe a specific sequence. In the description, claims and the brief description of the drawings of the present disclosure, when an element is described as being "fixed on" or "mounted on" or "disposed on" or "connected to" another element, the element can be directly or indirectly located on the other element. For example, when an element is described as being "connected to" another element, the element can be directly or indirectly connected to the other element.

In addition, when an "embodiment" is referred to herein, it means that specific features, structures, or characteristics described with reference to the embodiment can be included in at least one embodiment of the present disclosure. When used in different locations in the description, this term does not necessarily refer to the same embodiment and does not refer to an independent or alternative embodiment mutually exclusive to other embodiments. Those skilled in the art explicitly and implicitly understand that the embodiments described herein can be combined with other embodiments.

Figure 3:
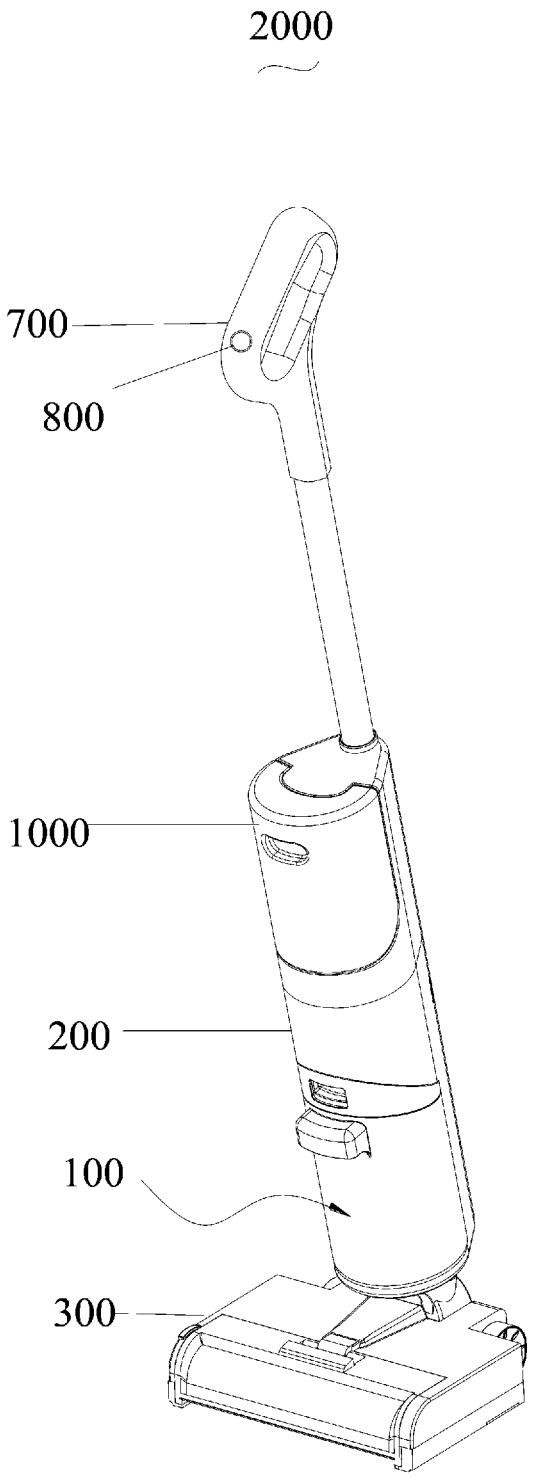
FIG. 3 is a perspective structural view of a vacuum cleaner according to an embodiment of the present disclosure.
Figure 4:
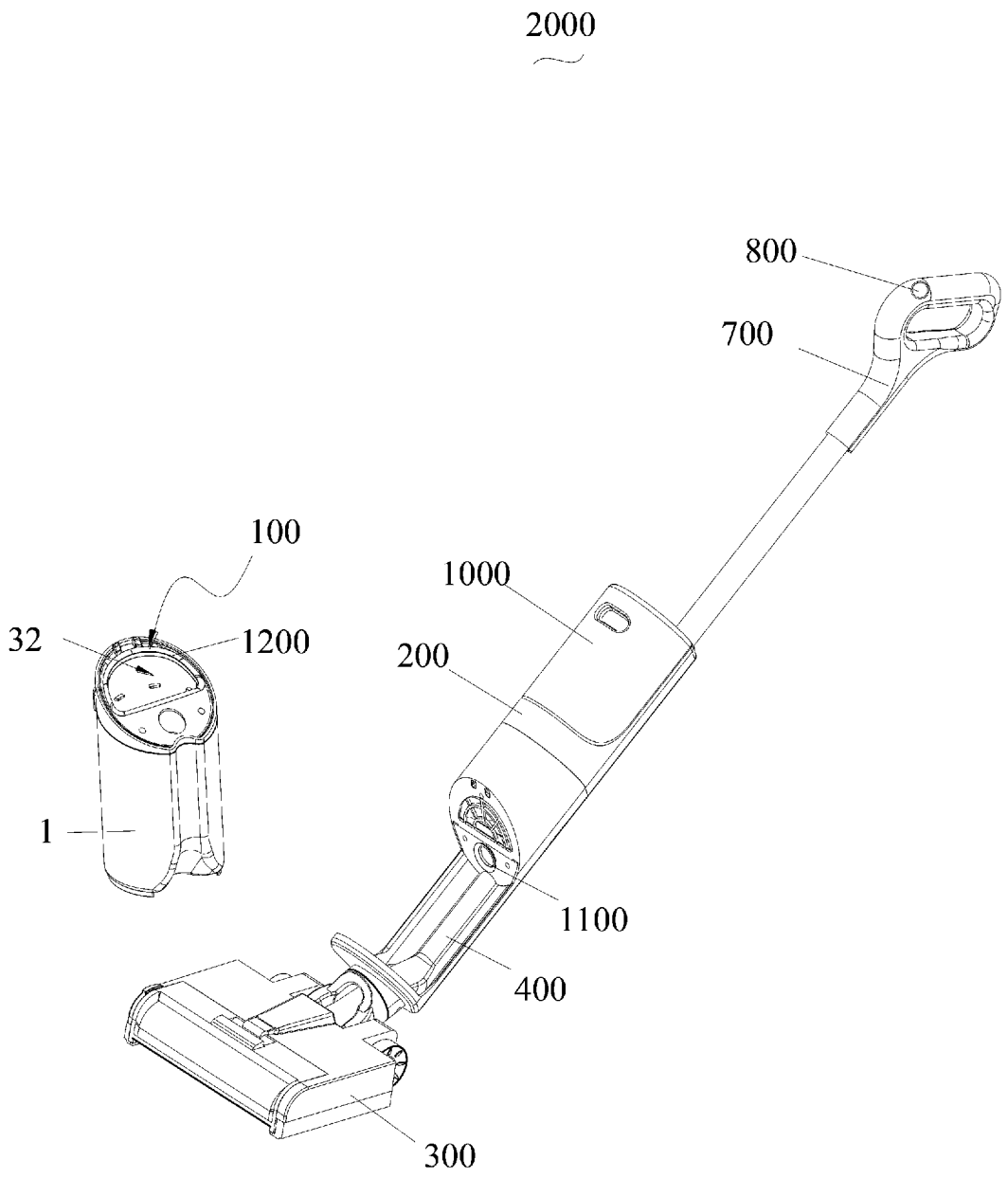
FIG. 4 is an exploded view of a partial structure of the vacuum cleaner in FIG. 3.
Figure 5:
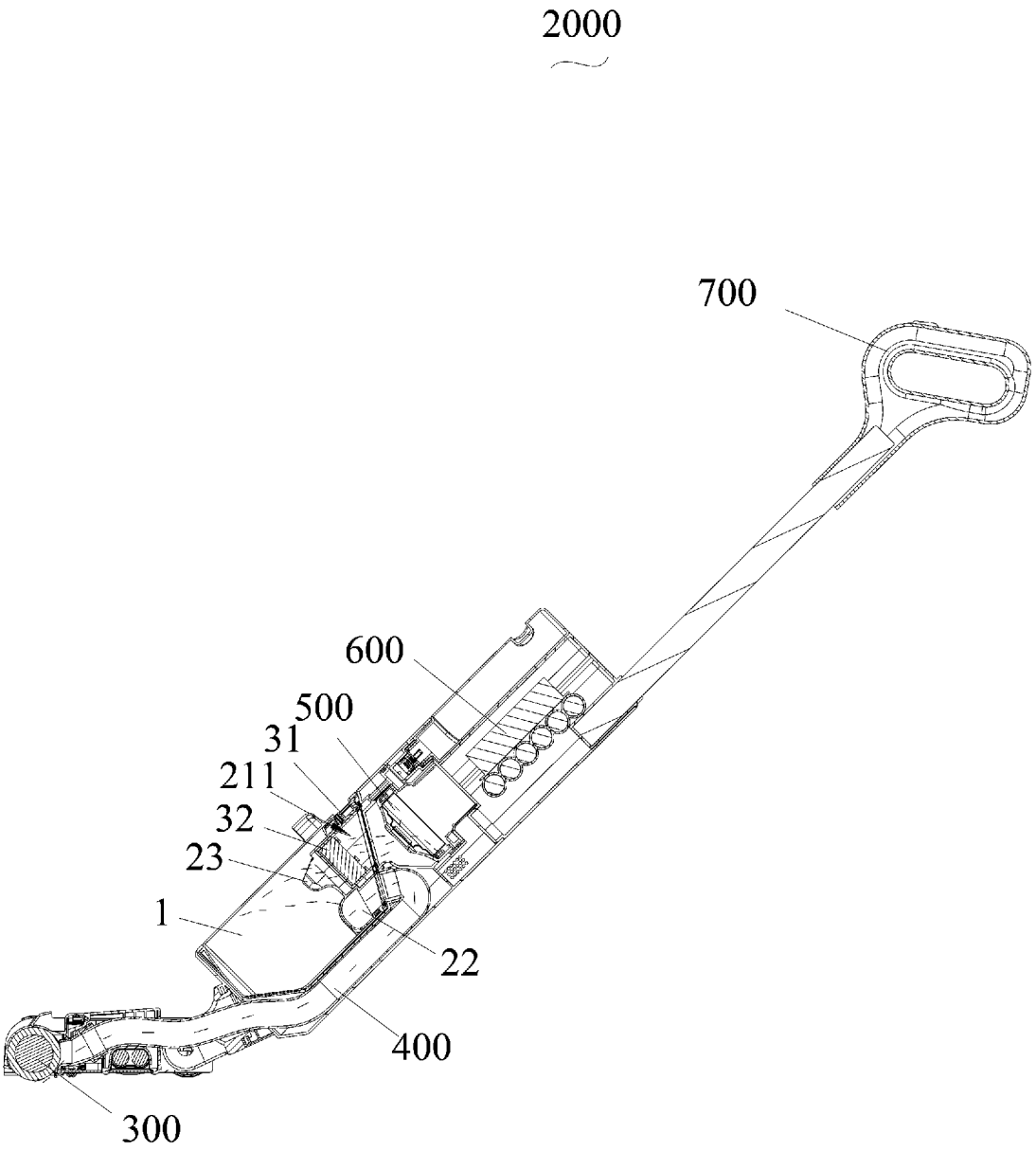
FIG. 5 is a sectional view of a longitudinal cross-section of the vacuum cleaner in FIG. 3.

It should be noted that the water tank structure 100 is used in a cleaning apparatus and is configured to store debris and/or dirty water. For example, the water tank structure 100 is used in a vacuum cleaner 2000. As shown in FIG. 3 to FIG. 5, the vacuum cleaner 2000 includes the water tank structure 100, a machine body 200, a floor brush 300, a connecting tube 400, a suction producing device 500, etc. The floor brush 300, the water tank structure 100 and the suction producing device 500 are sequentially mounted on the machine body 200 from bottom to top. The water tank structure 100 is used to store dirty water and debris collected after floor scrubbing (the material of the floor being scrubbed is not limited) by the floor brush 300 of the vacuum cleaner 2000. Certainly, in other embodiments, the water tank structure 100 can also be used in other cleaning apparatuses, and is not specifically limited herein. For ease of description, the following description mainly focuses on the vacuum cleaner 2000.

An embodiment of the present disclosure specifically further provides a water tank structure 100. As shown in FIG. 1, the water tank structure 100 includes a tank body 1 and a tank cover assembly 2. The tank body 1 has an accommodation cavity 11 therein, and an end of the tank body 1 is formed with an opening 12 in communication with the accommodation cavity 11. The tank cover assembly 2 includes a cover body 21 and at least one flow divider 22, and the cover body 21 is disposed at an end of the tank body 1 proximate to the opening 12. The flow divider 22 is in communication with the cover body 21 and the accommodation cavity 11. The flow divider 22 is configured to divide a fluid flowing therethrough into a plurality of fluid streams formed into pairs having paired kinetic energies carried thereby and paired opposing flow directions, such that the kinetic energies of the pairs of fluid streams cancel out to increase the available space of the water tank structure 100. It should be noted that as used in the statement "the plurality of fluid streams formed into pairs having paired opposing flow directions," "paired opposing flow directions" means "paired completely opposing flow directions" or "paired substantially opposing flow directions."

It can be understood that when subject to suction, a fluid such as air-entrained dirty water and debris enters the cover body 21 and then flows through the flow divider 22, and the air-entrained dirty water and debris are divided in the flow divider 22 into the plurality of fluid streams formed into pairs having paired kinetic energies carried thereby and paired opposing flow directions. The plurality of fluid streams flow into the accommodation cavity 11 and collide with each other such that the kinetic energies of the pairs of fluid streams cancel out to increase the available space of the water tank structure 100, such that the air entrained in the dirty water and debris is separated therefrom. The dirty water and debris subject to an inertial effect caused by gravity enter the bottom of the accommodation cavity 11 of the tank body 1, and the air is discharged to an external environment such that an interaction between kinetic energy of the air and kinetic energy of the dirty water and debris in the tank body 1 is suppressed, and fluctuation of the liquid level in the accommodation cavity 11 of the tank body 1 is suppressed, thereby effectively preventing the dirty water and debris from being blown away by the air into a motor or to the external environment, increasing the degree of separation of the air from the dirty water and debris and further increasing the available space of the water tank.

In some embodiments, the plurality of fluid streams form into pairs having equal kinetic energies carried thereby. It should be noted that as used in the statement "the plurality of fluid streams form into pairs having equal kinetic energies carried thereby," "equal" means "completely equal" or "substantially equal," such that the kinetic energies of the pairs of fluid streams cancel out to increase the available space of the water tank structure 100, thereby further effectively preventing the dirty water and debris from being blown away by the air into the motor or to the external environment and increasing the degree of separation of the air from the dirty water and debris.

In some embodiments, the ratio of the maximum kinetic energy to the minimum kinetic energy carried by any one of the plurality of pairs of fluid streams is greater than 0.9 such that the degree of separation of the air from the fluid can be further improved when the plurality of fluid streams collide with each other. It should be noted, any difference between the maximum kinetic energy and the minimum kinetic energy carried by any one of the plurality of pairs of fluid streams is included within the scope of this disclosure as long as the difference falls within the range of kinetic energy differences enabling the separation of the air from the fluid.

In some embodiments, the plurality of fluid streams form into pairs having mutually-mirroring flow directions, such that after entering the accommodation cavity 11, the plurality of fluid streams can accurately collide with each other head-on, thereby increasing the degree of collision between fluid streams and further improving the separation between water and air. It should be noted that as used in the statement "the plurality of fluid streams form into pairs having mutually-mirroring flow directions," "mutually-mirroring flow directions" means "completely mutually-mirroring flow directions" or "substantially mutually-mirroring flow directions."

Figure 2:
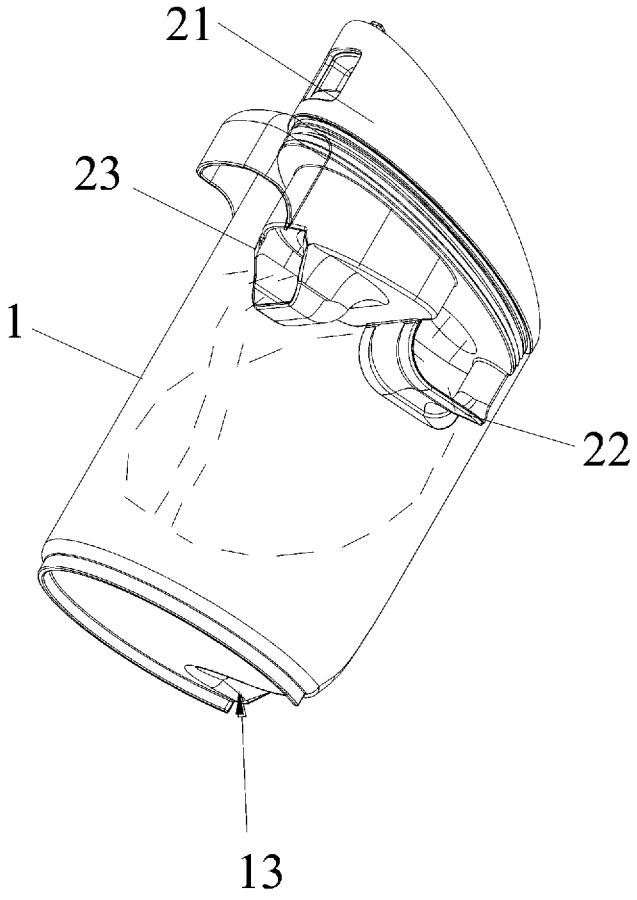
FIG. 2 is a perspective structural view of the water tank structure in FIG. 1.

An embodiment of the present disclosure provides a water tank structure 100. As shown in FIG. 1 and FIG. 2, the water tank structure 100 includes a tank body 1 and a tank cover assembly 2. The tank cover assembly 2 is disposed on a top end of the tank body 1.

Specifically as shown in FIG. 1 and FIG. 2, the tank body 1 has an accommodation cavity 11 therein. It can be understood that the tank body 1 can specifically be in the shape of a cup, no other structures are present in the accommodation cavity 11 of the tank body 1, and an inner wall of the accommodation cavity 11 is smooth and rounded so as to facilitate rinsing. In addition, an end (specifically the top end) of the tank body 1 is formed with an opening 12 in communication with the accommodation cavity 11. The tank cover assembly 2 includes a cover body 21 and a first flow channel 22. The cover body 21 is disposed on an end (specifically the top end) of the tank body 1 proximate to the opening 12. It can be understood that the cover body 21 of the tank cover assembly 2 covers the tank body 1 such that a sealed space is formed in the tank body 1. The cover body 21 can specifically be detachable relative to the tank body 1 such that the tank body 1 can be detached therefrom and cleaned. The first flow channel 22 is in communication with the cover body 21 and the accommodation cavity 11. A terminal end of the first flow channel 22 is provided with an even number of outlets 221.

A fluid flowing in through the first flow channel 22 is divided into the same number of fluid streams as the number of the outlets 221, and a plurality of fluid streams are formed into pairs, in which the plurality of fluid streams form into pairs having equal kinetic energies carried thereby. It should be noted that the statement "the plurality of fluid streams form into pairs having equal kinetic energies carried thereby" means the plurality of fluid streams form into pairs having completely equal or substantially equal kinetic energies carried thereby.

It can be understood that the operating principle of the water tank structure 100 is substantially as follows: when subject to suction, a fluid such as air-entrained dirty water and debris enters the cover body 21, then flows through the first flow channel 22 and collides with an inner tube wall of the first flow channel 22 such that the air-entrained dirty water and debris are divided in the first flow channel 22 and are divided by the outlets 221 into the same number of fluid streams as the number of the outlets 221, and a plurality of fluid streams are formed into pairs. The plurality of fluid streams flow into the accommodation cavity 11 and collide with each other such that the air entrained in the dirty water and debris is separated therefrom. The dirty water and debris subject to the inertial effect caused by gravity enter the bottom of the accommodation cavity 11 of the tank body 1, and the air is discharged to an external environment.

In summary, compared with the prior art, the water tank structure 100 has at least the following benefits: in the water tank structure 100, the first flow channel 22 is disposed on the cover body 21 covering the tank body 1 such that the fluid, such as the air-entrained dirty water and debris, can flow through the first flow channel 22 into the accommodation cavity 11 of the tank body 1, and the air is separated from the dirty water and debris and discharged to the external environment. In addition, the first flow channel 22 is disposed on the cover body 21 of the tank cover assembly 2, thereby simplifying the internal structure of the tank body 1, reducing occupied space and facilitating cleaning. In addition, when subject to suction, a fluid such as air-entrained dirty water and debris flows from the cover body 21 through the first flow channel 22 and is divided by the outlets 221 of the first flow channel 22 into the same number of fluid streams as the number of the outlets 221, and a plurality of fluid streams are formed into pairs. The plurality of fluid streams flow into the accommodation cavity 11 and collide with each other to generate opposing cyclone air streams colliding with each other such that an interaction between kinetic energy of the air and kinetic energy of the dirty water and debris in the tank body 1 is suppressed, and fluctuation of the liquid level in the accommodation cavity 11 of the tank body 1 is suppressed, thereby effectively preventing the dirty water and debris from being blown away by the air into a motor or to the external environment and increasing the degree of separation of the air from the dirty water and debris. In summary, the water tank structure 100 has a simple structure and large storage space, can be easily cleaned and has high degree of separation of air from dirty water and debris.

In order to enable those skilled in the art to better understand the solutions of the present disclosure, the technical solutions in the embodiments of the present disclosure will be described below with reference to the drawings.

In some embodiments, the tank cover assembly 2 further includes a second flow channel 23, and the second flow channel 23 is in communication with the cover body 21 and the accommodation cavity 11.

The plurality of fluid streams collide with each other in the accommodation cavity 11 such that air entrained therein is separated therefrom, and the separated air is capable of flowing to the outside through the second flow channel 23. It can be understood that the second flow channel 23 is disposed on the cover body 21 of the tank cover assembly 2, thereby simplifying the internal structure of the tank body 1, reducing occupied space and facilitating cleaning. In addition, the plurality of fluid streams flow into the accommodation cavity 11 and collide with each other such that the air entrained in the dirty water and debris is separated therefrom. The dirty water and debris subject to the inertial effect caused by gravity enter the bottom of the accommodation cavity 11 of the tank body 1, and the air can be smoothly discharged to an external environment by means of the second flow channel 23.

In some embodiments as shown in FIG. 1 and FIG. 2, all of the outlets 221 of the first flow channel 22 are directed towards a side wall of the tank body 1. It can be understood that when subject to suction, a fluid such as air-entrained dirty water and debris flows from the cover body 21 into the first flow channel 22, and when subject to the suction and the inertial effect caused by gravity of the dirty water and debris, the dirty water and debris entering the first flow channel 22 is divided into the same number of fluid streams as the number of the outlets 221 when colliding with the inner tube wall of the first flow channel 22, and a plurality of fluid streams are formed into pairs and flow through corresponding outlets 221 respectively into the accommodation cavity 11. After entering the accommodation cavity 11, the plurality of fluid streams all hit the side wall of the tank body 1 and then change directions again to generate opposing cyclone air streams colliding with each other such that an interaction between kinetic energy of the air and kinetic energy of the dirty water and debris in the tank body 1 is suppressed, and fluctuation of the liquid level in the accommodation cavity 11 of the tank body 1 is suppressed, thereby effectively preventing the dirty water and debris from being blown away by the air into a motor or to the external environment and improving the separation between water and air.

In some embodiments, an inlet of the second flow channel 23 is directed towards a side wall of the tank body 1 so as to better prevent surges in the tank body 1 from entering the inlet of the second flow channel 23, thereby further increasing the utilization rate of storage space in the tank body 1. It should be noted that the inlet of the second flow channel 23 and the outlets 221 of the first flow channel 22 are offset so as to prevent the fluid flowing out of the outlets 221 of the first flow channel 22 from directly flowing out through the inlet of the second flow channel 23.

In some embodiments as shown in FIG. 1 and FIG. 2, a top end surface of the cover body 21 is sloped, the cover body 21 includes a low end and a high end connected to the low end, and the second flow channel 23 is correspondingly disposed at the high end of the cover body 21. It should be noted that the low end of the cover body 21 refers to an end of the cover body 21 where the distance between the top end surface of the cover body 21 and the bottom of the tank body 1 is the shortest, and the high end of the cover body 21 refers to an end of the cover body 21 where the distance between the top end surface of the cover body 21 and the bottom of the tank body 1 is the longest. It can be understood that in a cleaning process of a cleaning apparatus such as the vacuum cleaner 2000, the accommodation cavity 11 of the tank body 1 is stored with dirty water and debris such that movement of the vacuum cleaner 2000 causes the dirty water stored inside the tank body 1 to form surges. The second flow channel 23 is thus disposed at the high end of the cover body 21 such that the inlet of the second flow channel 23 is located as far as possible away from the bottom of the tank body 1 in a limited space, and therefore the surges are prevented from entering the inlet of the second flow channel 23, thereby further improving the utilization rate of the storage space of the tank body 1.

In some embodiments as shown in FIG. 1, the tank cover assembly 2 further includes a filtration assembly 3, and the filtration assembly 3 includes a support 31 and a filter 32.

As shown in FIG. 1 and FIG. 5, at a position corresponding to the outlet of the second flow channel 23, an end of the cover body 21 away from the tank body 1 has a discharging cavity 211 configured to cause the separated air to flow out, and the support 31 is disposed on the cover body 21. Specifically, the support 31 and the cover body 21 can be an integrally formed structure or separate structures, and is not specifically limited herein. A hollow portion (not shown) is disposed on the support 31, and the filter 32 is disposed on the hollow portion of the support 31. It can be understood that the support 31 is provided with the hollow portion at a position corresponding to the discharging cavity 211 such that the support 31 provided with the hollow portion can stably bear the filter 32 and also prevent the filter 32 from being detached from the support 31. In addition, the position of the hollow portion relative to the discharging cavity 211 enables the air flowing out of the second flow channel 23 to pass through the hollow portion of the support 31, be further filtered by the filter 32, and then be discharged to the external environment. It can be understood that the air separated from the dirty water and debris is filtered again using the filter 32 after being discharged from the second flow channel 23, thereby further purifying the air and effectively preventing dirty water or debris carried in the air from being carried out by the air. It should be noted that in this embodiment, the filter 32 can be a sponge filter. The sponge filter is resilient, has high filtration efficiency and low resistance to air and is repeatedly washable and cheap, and therefore the sponge filter is effective in filtering the air and reducing costs. In addition, in this embodiment, the filter 32 is semi-circular, and correspondingly the hollow portion of the support 31 is also semi-circular.

On the basis of the aforementioned water tank structure 100, an embodiment of the present disclosure further provides a vacuum cleaner 2000. As shown in FIG. 3 to FIG. 5, the vacuum cleaner 2000 includes a machine body 200 and the aforementioned water tank structure 100. The water tank structure 100 is vertically detachably connected to the machine body 200. It should be noted that in this embodiment, the water tank structure 100 is connected to the machine body 200 by means of an engagement structure 900. Specifically, the engagement structure 900 includes a fastener 910, a spring 920 and an engagement recess (not shown). The fastener 910 is connected to the cover body 21 using the spring 920. At a position corresponding to the fastener 910, the engagement recess is disposed on the machine body 200. The fastener 910 engages with and is connected to the engagement recess, thereby achieving a firm connection and facilitating detachment. It can be understood that the water tank structure 100 is detachably connected to the machine body 200; and when the water tank structure 100 needs to be cleaned, the water tank structure 100 is detached from the machine body 200 for cleaning, thereby achieving easy detachment and mounting.

In summary, compared with the prior art, the vacuum cleaner 2000 has at least the following benefits: in the water tank structure 100 used by the vacuum cleaner 2000, the first flow channel 22 is disposed on the cover body 21 covering the tank body 1 such that the fluid, such as the air-entrained dirty water and debris, can flow through the first flow channel 22 into the accommodation cavity 11 of the tank body 1, and the air is separated from the dirty water and debris and discharged to the external environment. In addition, the first flow channel 22 is disposed on the cover body 21 of the tank cover assembly 2, thereby simplifying the internal structure of the tank body 1, reducing occupied space and facilitating cleaning. In addition, when subject to suction, a fluid, such as air-entrained dirty water and debris, flows from the cover body 21 through the first flow channel 22 and is divided by the outlets 221 of the first flow channel 22 into the same number of fluid streams as the number of the outlets 221, and a plurality of fluid streams are formed into pairs. The plurality of fluid streams flow into the accommodation cavity 11 and collide with each other to generate opposing cyclone air streams colliding with each other such that an interaction between kinetic energy of the air and kinetic energy of the dirty water and debris in the tank body 1 is suppressed, and fluctuation of the liquid level in the accommodation cavity 11 of the tank body 1 is suppressed, thereby effectively preventing the dirty water and debris from being blown away by the air into a motor or to the external environment and increasing the degree of separation of the air from the dirty water and debris. In summary, the vacuum cleaner 2000 has a simple structure and large storage space, can be easily cleaned and has high degree of separation of air from dirty water and debris.

In some embodiments as shown in FIG. 4 and FIG. 5, the vacuum cleaner 2000 further includes a floor brush 300, a connecting tube 400 and a suction producing device 500. The floor brush 300, the water tank structure 100 and the suction producing device 500 are sequentially mounted on the machine body 200 from bottom to top. The floor brush 300 is configured to scrub a floor. The water tank structure 100 is configured to store dirty water and debris collected after floor scrubbing. The suction producing device 500 is configured to produce suction such that the air-entrained dirty water and debris collected after floor scrubbing by the floor brush 300 enter the water tank structure 100 and flow out therefrom. It should be noted that the machine body 200 has a container cavity (not shown) therein. The suction producing device 500 and a power source 600 are both accommodated in the container cavity, and a suction port of the suction producing device 500 is aligned with a bottom end of the machine body 200. At a position corresponding to the outlet of the second flow channel 23, the bottom end of the machine body 200 defines a hollow structure or a mesh structure, and the machine body 200 is provided with an air outlet in communication with the container cavity. The connecting tube 400 includes a first end and a second end opposing and connected to the first end, i.e., two opposite ends of the connecting tube 400. The first end of the connecting tube 400 is connected to the floor brush 300. The second end of the connecting tube 400 is connected to the tank cover assembly 2 of the water tank structure 100. The second end of the connecting tube 400 is configured to be in communication with the inlet of the first flow channel 22. When subject to suction produced by the suction producing device 500, air-entrained dirty water and debris collected after floor scrubbing by the floor brush 300 flow along the connecting tube 400 and through the first flow channel 22 and enter the accommodation cavity 11 of the tank body 1 to form liquid flows colliding with each other, such that air is separated therefrom, rises to an upper portion of the accommodation cavity 11, is discharged from the water tank structure 100 through the second flow channel 23, then enters the container cavity and flows out through the air outlet.

In some embodiments as shown in FIG. 2 and FIG. 4, in order to improve the compactness of the structure, an edge of the tank body 1 is recessed in the lengthwise direction of the machine body 200 towards a central axis of the tank body 1 to form a recess 13 for accommodating the connecting tube 400, such that the connecting tube 400 can be fit to the tank body 1 and extend into the tank body 1 from the top end thereof.

In some embodiments as shown in FIG. 5, the vacuum cleaner 2000 further includes the power source 600. The power source 600 is disposed in the machine body 200. The power source 600 is configured to supply power to the floor brush 300 and the suction producing device 500. It should be noted that in other embodiments, the vacuum cleaner 2000 can also be powered by main power, which is not specifically limited herein.

In some embodiments as shown in FIG. 4, the vacuum cleaner 2000 further includes a first seal member 1100. The first seal member 1100 is disposed at a connection point of the connecting tube 400 and the tank cover assembly 2. It should be noted that the first seal member 1100 can be specifically disposed at a tube opening of the connecting tube 400 or on the tank cover assembly 2. It can be understood that the first seal member 1100 improves sealing at a connection point of the connecting tube 400 and the tank cover assembly 2, thereby preventing the air entrained in the dirty water and debris from flowing out from the connection point of the connecting tube 400 and the tank cover assembly 2.

In some embodiments as shown in FIG. 4, the vacuum cleaner 2000 further includes a second seal member 1200. At a position at the outlet of the second flow channel 23, the second seal member 1200 is disposed at a connection point of the water tank structure 100 and the machine body 200. It should be noted that the second seal member 1200 can be specifically disposed at the outlet of the second flow channel 23 or on the machine body 200. It can be understood that the second seal member 1200 can improve sealing at the connection point of the outlet of the second flow channel 23 of the water tank structure 100 and the machine body 200, thereby preventing affecting the suction effect of the suction producing device 500.

In some embodiments as shown in FIG. 3, the vacuum cleaner 2000 further includes a clean water tank 1000. The clean water tank 1000 is disposed on the machine body 200. The clean water tank 1000 is connected to the floor brush 300 by means of a water tube so as to spray water to the floor brush 300 and provide a water source for scrubbing the floor.

In some embodiments as shown in FIG. 3, the vacuum cleaner 2000 further includes a handle 700. The handle 700 is disposed at the top end of the machine body 200 so as to facilitate gripping during cleaning, thereby improving use comfort.

In some embodiments as shown in FIG. 3, the vacuum cleaner 2000 further includes a power button 800. The power button 800 is disposed on the handle 700. The power button 800 is electrically connected to the power source 600 so as to control an operating state of the vacuum cleaner 2000.

The above descriptions are merely the preferred embodiments of the present disclosure, and are not intended to limit the present disclosure. For those skilled in the art, the present disclosure may have various alterations and changes. Any modifications, equivalent substitutions, improvements and the like made within the spirit and principle of the present disclosure shall fall within the scope of the claims of the present disclosure.

The invention claimed is:

1. A water tank structure, comprising:
a tank body; and
a tank cover assembly, wherein:
the tank body defines an accommodation cavity,
a first end of the tank body defines an opening in communication with the accommodation cavity,
the tank cover assembly comprises a cover body and a flow divider,
the cover body is disposed at the first end of the tank body proximate to the opening,
the flow divider is in communication with the cover body and the accommodation cavity,
the flow divider is configured to divide a fluid flowing therethrough into a plurality of fluid streams formed into pairs, and
each of the pairs of fluid streams has paired kinetic energies and paired opposing flow directions such that the kinetic energies of the pair of fluid streams cancel out.

2. The water tank structure according to claim 1, wherein a ratio of a maximum kinetic energy to a minimum kinetic energy carried by any one of the pairs of fluid streams is greater than 0.9.

3. A water tank structure, comprising:
a tank body; and
a tank cover assembly, wherein:
the tank body defines an accommodation cavity,
a first end of the tank body defines an opening in communication with the accommodation cavity,
the tank cover assembly comprises a cover body and a first flow channel,
the cover body is disposed at the first end of the tank body proximate to the opening,
the first flow channel is in communication with the cover body and the accommodation cavity,
a terminal end of the first flow channel is provided with an even number of outlets,
a fluid flowing in through the first flow channel is divided into a same number of fluid streams as the number of the outlets, and
the fluid streams are formed into pairs, in which a first fluid stream of each pair and a second fluid stream of each pair have equal kinetic energies.

4. The water tank structure according to claim 3, wherein:
the tank cover assembly comprises a second flow channel,
the second flow channel is in communication with the cover body and the accommodation cavity,
the fluid streams collide with each other in the accommodation cavity such that air entrained in the fluid streams is separated therefrom, and
the air separated from the fluid streams flows outside through the second flow channel.

5. The water tank structure according to claim 4, wherein all of the outlets of the first flow channel are directed towards a side wall of the tank body.

6. The water tank structure according to claim 4, wherein:
a top end surface of the cover body is sloped,
the cover body comprises a first end having a first height and a second end connected to the first end and having a second height greater than the first height, and
the second flow channel is correspondingly disposed at the second end of the cover body.

7. The water tank structure according to claim 4, wherein:
the tank cover assembly comprises a filtration assembly,
the filtration assembly comprises a support and a filter,
at a position corresponding to an outlet of the second flow channel, an end of the cover body away from the tank body defines a discharging cavity configured to cause the air separated from the fluid streams to flow out,
the support is disposed on the cover body,
at a position corresponding to the discharging cavity of the cover body, a hollow portion is disposed on the support, and
the filter is disposed on the hollow portion of the support.

8. A water tank structure, comprising:
a tank body; and
a tank cover assembly, wherein:
the tank body defines an accommodation cavity,
a first end of the tank body defines an opening in communication with the accommodation cavity,
the tank cover assembly comprises a cover body and a flow divider defining a first outlet and a second outlet,
the flow divider is configured to cause a first portion of a fluid to flow in a first direction toward the first outlet and generate a first kinetic energy,
the flow divider configured to cause a second portion of the fluid to flow in a second direction toward the second outlet and generate a second kinetic energy,
the first direction is different than the second direction,
at least a portion of the first kinetic energy and at least a portion of the second kinetic energy are cancelled out by a collision therebetween,
the cover body is disposed at the first end of the tank body proximate to the opening, and
the flow divider is in communication with the cover body and the accommodation cavity.

9. A vacuum cleaner, comprising:
a machine body; and
the water tank structure according to claim 8, wherein:
the water tank structure is detachably connected to the machine body, and
the collision between the at least a portion of the first kinetic energy and the at least a portion of the second kinetic energy keeps the fluid from entering the machine body.

10. The vacuum cleaner according to claim 9, wherein:
the vacuum cleaner comprises a floor brush, a suction producing device, and a connecting tube,
the floor brush, the water tank structure, and the suction producing device are sequentially mounted on the machine body,
the connecting tube comprises a first end and a second end opposing and connected to the first end,
the first end of the connecting tube is connected to the floor brush,
the second end of the connecting tube is connected to the tank cover assembly of the water tank structure and is configured to be in communication with an inlet of the flow divider,
when subject to suction produced by the suction producing device, the fluid collected by the floor brush flows along the connecting tube and through the flow divider into the accommodation cavity of the tank body.

11. The vacuum cleaner according to claim 10, wherein:
the tank cover assembly comprises a second flow channel,
the second flow channel is in communication with the cover body and the accommodation cavity,
the fluid flowing from the first outlet and the fluid flowing from the second outlet collide with each other in the accommodation cavity such that air entrained in the fluid is separated therefrom,
the vacuum cleaner comprises a second seal member, and
at a position at an outlet of the second flow channel, the second seal member is disposed at a connection point of the water tank structure and the machine body.

12. The vacuum cleaner according to claim 11, wherein:
the air separated from the fluid flows outside through the second flow channel,
the tank cover assembly comprises a filtration assembly,
the filtration assembly comprises a support and a filter,
at a position corresponding to an outlet of the second flow channel, an end of the cover body away from the tank body defines a discharging cavity configured to cause the air separated from the fluid to flow out,
the support is disposed on the cover body,
at a position corresponding to the discharging cavity of the cover body, a hollow portion is disposed on the support, and
the filter is disposed on the hollow portion of the support.

13. The water tank structure according to claim 8, wherein the first kinetic energy is equal to the second kinetic energy.

14. The water tank structure according to claim 8, wherein the first outlet faces in a third direction and the second outlet faces in a fourth direction different than the third direction.

15. The water tank structure according to claim 14, wherein the third direction is opposite to the fourth direction.

16. The water tank structure according to claim 8, wherein the flow divider is suspended from the tank cover assembly in the accommodation cavity.

17. The water tank structure according to claim 8, wherein the cover body comprises a discharging cavity through which air escapes from the accommodation cavity.

18. The water tank structure according to claim 17, wherein the flow divider is disposed at a front of the tank cover assembly and the discharging cavity is disposed behind the flow divider.

19. The water tank structure according to claim 17, wherein:
the cover body comprises a suction opening for generating a negative pressure in the accommodation cavity, and
the suction opening and the discharging cavity are located on an upper side of the water tank structure.

20. The water tank structure according to claim 19, wherein:
the water tank structure is detachably connected to a machine body, and
the suction opening and the discharging cavity are located on a side of the tank cover assembly approximate the machine body.

* * * * *